United States Patent [19]

Russomanno

[11] Patent Number: 4,534,071

[45] Date of Patent: Aug. 13, 1985

[54] AUTOMATIC DISPENSER FOR DISINFECTANT AND BOWL CLEANING FLUID

[75] Inventor: Charles Russomanno, Irvington, N.J.

[73] Assignee: Block Drug Company, Inc., Jersey City, N.J.

[21] Appl. No.: 637,748

[22] Filed: Aug. 6, 1984

[51] Int. Cl.[3] ..... E03D 9/02

[52] U.S. Cl. ..... 4/228; 4/222; 4/227

[58] Field of Search ..... 4/222, 227, 228; 222/213, 212, 214, 206, 67–68, 207

[56] References Cited

U.S. PATENT DOCUMENTS

| | | | |
|---|---|---|---|
| 2,705,094 | 3/1955 | Howell, Jr. | 4/228 UX |
| 2,736,039 | 2/1956 | Majo | 4/227 |
| 2,772,817 | 12/1956 | Jauch | 222/213 |
| 3,874,007 | 4/1975 | Dolan | 4/228 |
| 4,491,988 | 1/1985 | Mizuno | 4/228 |

*Primary Examiner*—Henry K. Artis

*Attorney, Agent, or Firm*—Ostrolenk, Faber, Gerb & Soffen

[57] ABSTRACT

An automatic dispenser for disinfectant and bowl cleaning material adapted to be suspended stationarily in the tank of a flushing bowl wherein the dispenser comprises a container with ball valve floated against the tapered interior of an upper opening in the container and an adjustable drainpipe in the bottom of the container with the adjustable drainpipe having an upper tapered opening and a ball valve for closing the same as well as lower openings extending downwardly outside the container providing passage for container water or tank water as the case may be. In operation the two ball valves are floated to the top of their respective openings sealing the openings and isolating the water in the dispensing container. The dispensing container is provided with preferably a block of soluble disinfectant cleaning material such as a hypochlorite which will dissolve very slowly into the water in the container. When the tank is flushed, the water level in the container drops together with the water level in the tank thereby displacing the container and drainpipe ball valves allowing the disinfectant solution to be dispensed. The disinfectant solution flows out through the drainpipe, and openings in the drainpipe extending below the lower level of the container, into the tank and eventually to the bowl. When the flushing operation is finished, the rising of the water in the tank permits the ball valves to close.

5 Claims, 3 Drawing Figures

AUTOMATIC DISPENSER FOR DISINFECTANT AND BOWL CLEANING FLUID

SUMMARY OF THE INVENTION

The present invention relates to toilet bowl cleaners and more particularly to a toilet bowl cleaner which, although it is stationarily located in the toilet tank, becomes dynamically active to dispense cleaning and disinfecting material into the toilet tank water at the time the flushing of the toilet bowl and tank occurs. This invention is directed to a device which utilizes the dropping of the water level in the tank during flush for the dispensing action of the cleaning and disinfecting material.

Two ball stop mechanisms are involved comprising floating ball valves. One of the ball stops is engaged with a narrowing tapering section and opening at the top of an internal container which is suspended in the tank. This container carries preferably a block of the disinfecting and cleaning material. The said container is provided with a drain comprising a tubular member adjustably inserted through the bottom of the container and having a plurality of openings at the lower end extending from the bottom of the container and a ball stop arrangement at the other end wherein a floating ball valve engages a tapered valve section at the upper end of the drain to close the same.

Thus, in the static condition, the ball stops engage in their respective tapered openings, substantially isolate the container from the tank water and permit the disinfecting material in the form of a block supported on the lower wall of the container gradually to dissolve at a predetermined selected rate depending on the density and compacting of the material into the water in the container and thereby create a concentration of such material.

On the occurrence of a flushing operation where the water level in the tank drops, both ball stops open when the level drops during the flush allowing the disinfecting and cleaning material which has formed a hypochlorite solution to drain out through the openings in the drainpipe into the tank water.

Thereafter, as the water level rises during the refilling of the tank, the ball stops float upwardly to close off both the drain and the top container opening. The buoyancy of the floating ball stops, which are preferably made of a relatively inert plastic material, against the inside of the tapered or beveled openings, prevents the diffusion of hypochlorite into the tank water between flushes and thus permits the concentration of the hypochlorite solution to build up in the container.

ADVANCE OVER THE PRIOR ART

Disinfecting and cleaning dispensing devices have been known and utilized including a substantial number of different devices which have been placed in the toilet tank of a flush toilet or hung on the inside of the toilet tank by any suitable device which will pass over the top lip of the toilet tank. In many instances such devices have been passive in the sense that they provided a continuous, relatively small flow of disinfecting and cleaning material into the toilet tank water regardless of the operation of the toilet tank. Other prior devices were active in the sense that the dispensing of the material into the toilet tank or toilet bowl water, was in response to the flushing operation. In each instance, however, the disinfecting or cleaning material was not for the most part permitted to reach its own level of concentration in a separate compartment before the actual dispensing thereof.

In instances such as the earlier device shown in the W. L. Miller U.S. Pat. No. 1,091,374, the device was required to operate in such a manner that it necessarily rested on the bottom of the tank rather than being hung from the side. Also prior devices were arranged as in the patent to Frank Joseph Mack, U.S. Pat. No. 3,698,021 to contain a predetermined volume of liquid cleaner as opposed to the utilization of a solid active ingredient which dissolves in water. Such devices were not adjustable and required, in effect, a measuring chamber. The utilization of liquid material as the source for a disinfectant limited to a subsantial extent the amount of disinfectant that could be placed in the tank for any one series of flushes.

Other devices, such as those in the French Pat. No. 2,065,181 providing for a metering type of dispensing structure which was complex in use, failed very readily and provided an unnecessarily complicated way of measuring a dosage where the particular amount of dosage or infeed of material was not critical as long as the amount was above a certain level.

Other prior devices, such as the patent to Leinberry U.S. Pat. No. 4,285,074, provided for liquid storage of the disinfectant rather than for a solid pack, were limited in the number of operations before replacement.

Other patents, such as Keimig U.S. Pat. No. 3,913,151 utilizing a metering valve, again became more complex and unnecessarily sophisticated in providing measured doses of disinfectant where what is primarily needed is a disinfectant and cleaner which operates at or above a desired level.

Prior patents, such as Dirksing U.S. Pat. No. 4,171,546, provide for a predetermined dose volume of tank water being transferred into the dispenser and a corresponding amount being transferred out leading to an unnecessary complexity and sophistication in operation which are not necessary in the device.

Patents such as Dolan U.S. Pat. No. 4,131,958 utilize an air-lock mechanism to prevent the concentrated solution from being totally dispensed during a single flush. This becomes necessary where, as in Dolan, a liquid disinfectant is used without means for replenishing the liquid.

Devices such as Foley U.S. Pat. No. 3,831,205 must rest on the bottom of the tank and depend on a balance between the water which enters at the inlet tube at the top of the tank and the dispensing or cleaning solution from a horizontal passage located below the inlet opening, the solution occupying the space between the inlet and outlet being dispensed. This again is unnecessarily complex in operation.

Although the flush tank has been in use for many years and various dispensing devices for disinfecting and cleaning have been in use for many years, this invention presents the concept of a hanging device in which a pair of valves at the top and bottom isolate a chamber in which a solid block of disinfecting and/or cleaning material dissolves slowly in water trapped in the container to provide the disinfecting solution. This is used in combination with the fact that the container is isolated from the tank water at all times except upon refilling of the tank, in which case the semi-drained device is refilled with fresh incoming water through the top opening. The container ball valve rises with the incoming water eventually closing off the top opening when the container is refilled. The two ball valves are utilized top and bottom to effect this isolation in the simplest possible way although, of course, ball valves have been available for many years.

The present invention functions in an unexpected way because in addition to the fact that the container is not isolated during the flushing operation and becomes isolated following the flushing operation, the utilization of solid material in the container which dissolves slowly into the isolated water of the container, creates the condition, wherein an isolated container is replenished by the flush operation and the slow dissolution of the block of disinfecting and cleaning material into the container. It is the combination of isolation of the container and the replenishment of the active solution in the container that makes the concept work.

OBJECTS OF THE INVENTION

Thus, the primary object of the present invention is the provision of a hanging device that may be placed along the side of the tank wall and completely submerged below the water level when the tank is full.

A further object of the invention is the utilization of such cleaning and disinfectant solution dispensing mechanism so that it operates on the dropping of the water level in the tank during flushing.

A further object of the invention is to provide an isolated container for the hypochlorite disinfecting and cleaning block where, in between flushes, the hypochlorite concentration of the water inside the container of the dispensing device increases according to the solubility of the hypochlorite tablet which is used.

A further object of the present invention is the arrangement of solution inside the dispensing device so that it is closed off from the outside tank water by individual valves or ball stops at the top opening of the container for the solution and the drain openings respectively.

A further object of the present invention is the arrangement of the dispensing device so that when the tank is flushed and the water level drops the floating ball stop valves will descend away from the tapered openings with which they engage and thereby allow the water inside the device to drain and also to permit tank water to refill the container of the dispensing device.

A further object of the present invention is the provision of a drainpipe at the bottom of the container with its own ball stop valve inside the container and with openings in the drainpipe outside the container wherein a plurality of openings are used and wherein the volume of liquid dispensed is a function of the height of the drain opening inside the container. It is not a function of the number of holes in the drainpipe. The holes function to disperse the liquid as it is dispensed into the tank water in order to provide an appropriate balance between the amount of treated water dispensed during the flushing and the size of the tank.

The foregoing and many other objects of the present invention will become apparent in the following description and drawings.

DESCRIPTION OF THE PREFERRED EMBODIMENTS

Figure 1:
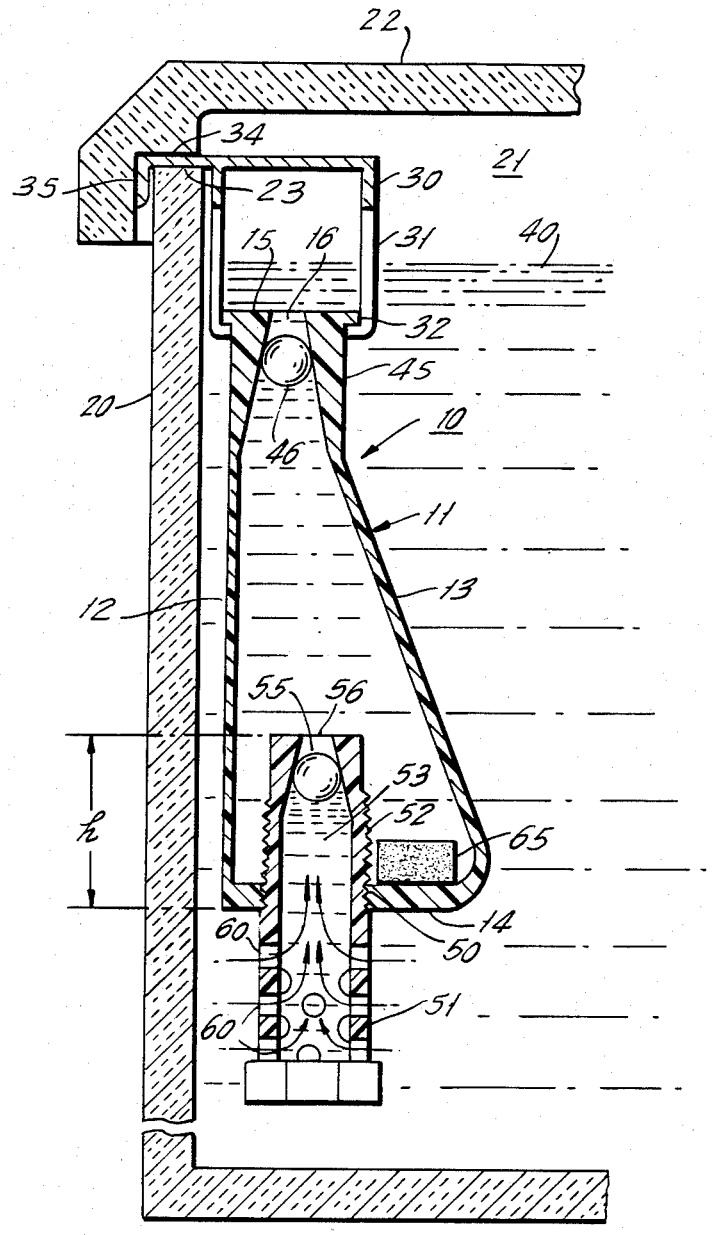
FIG. 1 is a cross-sectional view of the dispensing device of the present invention mounted in the tank showing the at-rest condition between flushes with the device completely submerged in the water in the tank and the ball stops arranged to prevent solution from being dispensed from the device into the tank.

Referring now to the drawings, the dispensing device 10 comprises a container 11 having a rear wall 12, a front wall 13, a bottom wall 14 and a top 15 having an opening 16. While rear wall 12 and front wall 13 have been referred to, these may not necessarily be discretely identifiable walls. The container 11 may be partially or substantially circular in horizontal cross-section with a flattened section forming the rear wall 12 which may be continuous with the rest of the wall of the container to form the front wall 13. It is sufficient here to point out that the wall which has been called the front wall 13 tapers toward the rear wall as shown. The rear wall 12 is so arranged that it will preferably extend along the side of the wall 20 of the toilet tank 21 having the removable cover 22 which rests against the top edge 23 of the container of the tank wall 20.

The dispensing device 10 is provided with a support member 30 comprising at least a pair of legs or prongs 31 which engage the lip 32 at the top 15 of the dispensing device 10. The support member has an extension 34 and a flange 35 which go over the top edge 23 of the tank wall 20 in order to support the dispensing device therefrom. The length of the legs or other supports 31 which engage the lip 32 of the dispensing device is such that the water level 40 in the tank 21 during normal usage will rise above the opening 16 in the dispensing device. As noted above, the supports 31 for the dispensing device constitute spaced legs or other supports or openings through which water may freely pass to the opening 16 of the dispensing device when that is necessary.

The container 11 of the dispensing device is tapered at 45 toward the opening 16 and is provided with the floating ball valve 46 which, as the water rises in the container 11 of the dispensing device, floats up into the tapered section 45 to block the opening 16.

The bottom of the container is provided with a screw-threaded opening 50 in which the drainpipe 51 is secured by the screw-threads 52. This permits adjustments of the height of opening 56 in the tank. The top of the drainpipe 51 is internally tapered at 53 so that the ball valve 55, when it rises therein because of the refilling of the tank, will engage the sides of the tapered section 53 and thus block off the entry opening 56 into the drainpipe 51.

The lower end of the drainpipe is provided with a plurality of openings 60, 60 through which water may exit back into the tank. The screw threaded drainpipe is not for adjustment of the number of openings which extend from the bottom of the container. The screw threaded drainpipe is to provide adjustment of the height of the drainpipe opening inside the device.

In operation as seen in FIG. 1, the ball valves 46 and 55 close their respective openings 56 and 16 and the water in the container 11 is thereby isolated from the tank. The hypochlorite block 65 resting on the lower wall of the dispensing container 14 may now dissolve slowly, or at a predetermined rate depending on the compacting of the block and whatever coating may be placed on the block or a perforated coating which may be placed on the block, into the water in the container 11. The block is of such material and such consistency that a desired level of disinfectant and cleansing agent of the order of five parts per million may be obtained in the dispensing container 11 within a reasonable time after a flushing operation, and this concentration may thereafter increase at a desired rate. The rate of solution of the material of the block 65 into the water in the container 11 is, however, relatively very slow compared to the size of the block so that the entire unit may last a long time.

The unit may be arranged so that the hypochlorite block 65 may be replaced by making the block small enough and the drainpipe 51 removable and the opening therefor large enough. But, preferably, the device is intended to be so relatively inexpensive and the block 65 is intended to be so long lasting that it would be simpler to replace the entire dispensing device when the hypochlorite block 65 is used up.

OPERATION OF THE INVENTION

Figure 3:
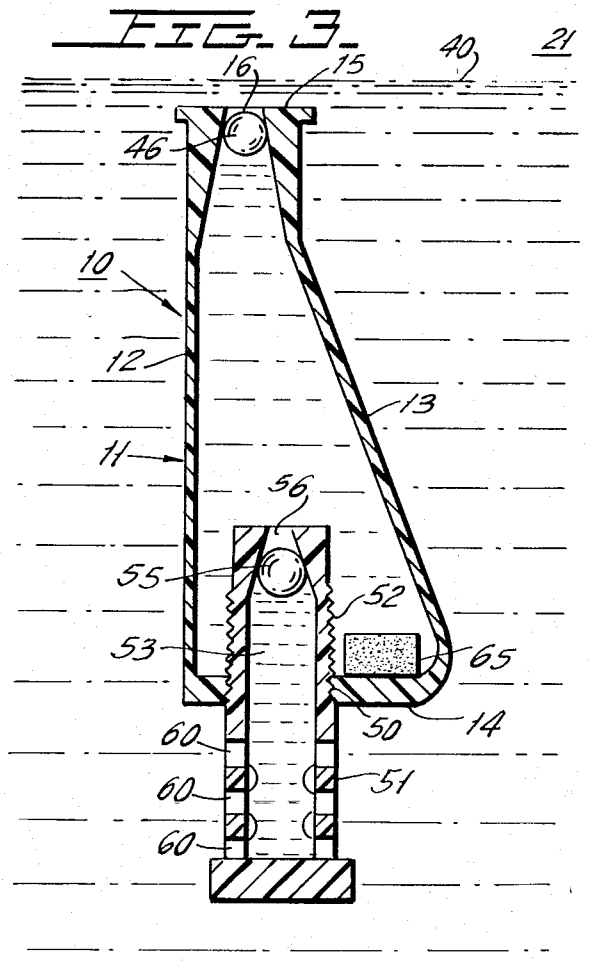
FIG. 3 is a cross-sectional view corresponding to the cross-sectional views of FIGS. 1 and 2 showing the condition of the tank and the dispensing device after the flushing operation wherein the tank has been refilled and the floating ball stops block the entry to the container as well as the exit from the container into the drain to complete the operation and reset the dispensing device to the condition shown in FIG. 1.
Figure 2:
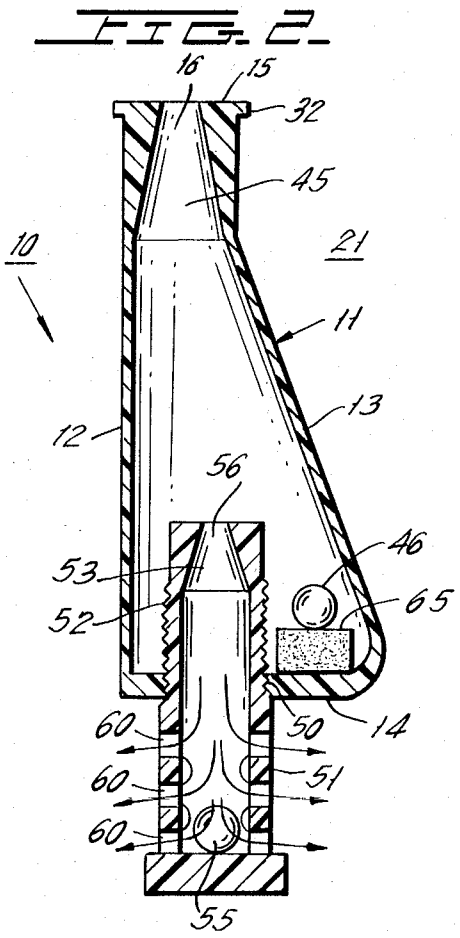
FIG. 2 is a vertical cross-sectional view corresponding to FIG. 1 but showing the operation of the dispensing device of the present invention during flushing operation wherein the water in the tank drops, the ball stops drop with the water inside the container and the drain and the hypochlorite solution is dispensed into the tank.

As seen now in the transition from the showing of FIG. 1 to the showing of FIG. 2, as the toilet bowl is flushed, the level of tank water 40 drops thereby causing the ball valve 46 to float downwardly away from the opening 16 and permit the water in the container 11 to drain away. The water level inside the device drops with the tank water level. The dispensing takes place as soon as the upper ball stop descends along with the water level. At the same time, as the water level in the tank 21 and the container 11 drops below the level of opening 56 and the tapered section 53 of the drainpipe 51, the ball valve 56 is driven downwardly first by reason of the dropping of the level and second by reason of the downrush of water and the momentarily increased pressure of the water flow to move the valve 55 away from the opening 56 and permit the water in the tank to drain through the openings 60 into the tank to provide a flow of disinfectant water into the tank during the flushing operation and thereafter as pointed out in connection with FIG. 3 to continue a flow of disinfecting water into the tank in preparation for the next flushing operation.

When the flushing operation is completed and the tank begins to refill, water flows into the device by flowing backward and upwardly in through the drainpipe from opening 60 up toward the opening 56 at the top of the drain. The ball valve 55 is raised as the water rises and eventually reaches the position shown in FIG. 1 closing off the top of the drainpipe. The water flows into the container 11 through the top opening 16 fills the container 11 until the ball valve 46 rises to close the opening 16 and the condition shown in FIG. 1 is reached wherein the water in the container 11 is isolated from the water in the tank 21 and permitted to become more and more concentrated with the hypochlorite solution as the water in the container 11 remains static prior to the next flush.

By this means, therefore, a simplified hanging disinfecting structure is provided which is totally automatic in operation, does not depend on captured or anchored or flapping valves or any mechanical operation of the valves but simply depends on the two floating ball valves which operate in effect as check valves closing the opening to the container and the opening to the drainpipe thereby isolating the container water so that it may slowly become more concentrated by its contact with the hypochlorite block.

Thus, in operation the user need merely operate the tank valve in the usual way without even being aware of the presence of the disinfecting device and the valve operation of the disinfecting device is entirely automatic responsive to water flow in the tank and providing material, therefore, which acts on the water in the tank opening and closing the valves in the dispensing device automatically in response to the water level and movement of water in the flush tank.

In the foregoing, the present invention has been described solely in connection with preferred illustrative embodiments thereof. Since many variations and modifications of the present invention will now be obvious to those skilled in the art, it is preferred that the scope of this invention be determined not by the specific disclosures herein contained but only by the appended claims.

What is claimed is:

1. A dispensing device for dispensing a liquid containing a cleaning and/or disinfecting material into the tank of a flush toilet wherein the dispensing device may be stationarily hung in the tank and the dispensing device comprises:

a container having a bottom wall and a top opening;

an interior floating ball valve for closing the top opening;

an opening in the bottom wall having a drainpipe inserted therein, the drainpipe having an opening at the top thereof inside the container and at least one opening in said drainpipe below the bottom of the container; and a floating ball valve responsive to the level of water within the drainpipe to close the opening at the top of the drainpipe;

said dispensing device being adapted to be supported in the container at a level wherein the top opening is below the top level of the water in the tank when the water in the tank is at rest;

said ball valves being displaced away from said openings and permitting water to flow therethrough when the water level in the tank drops thereby permitting water from the said container to flow out through the lower drainpipe opening into said tank; said ball valves being adapted to close said respective openings when the water level in the tank rises.

2. The dispenser of claim 1, wherein each of the openings in the container and the drainpipe is provided internally with a tapered access to said openings; said ball valves engaging said tapered access and closing said openings when the water level in the tank rises, said valves floating away from said openings when the water level in the tank drops.

3. The dispenser of claim 1, wherein a solid disinfecting and/or cleaning material is placed within the container; said solid material being adapted to dissolve slowly into the water of the container.

4. The dispenser of claim 2, wherein the drainpipe inserted in the opening at the bottom wall of the container is provided with a plurality of levels of openings from the interior of the drainpipe to the exterior thereof, below the bottom wall of the container.

5. The dispensing device of claim 4, wherein said drainpipe is adjustably positioned in the bottom wall of the container to vary and set the height of the opening at the top of the drainpipe.

* * * * *